US009804531B2

(12) United States Patent
Fujimori et al.

(10) Patent No.: US 9,804,531 B2
(45) Date of Patent: Oct. 31, 2017

(54) DEVELOPING DEVICE INCLUDING EXHAUST PASSAGE AND BLOCKING MEMBER AND IMAGE FORMING APPARATUS

(71) Applicant: FUJI XEROX CO., LTD., Tokyo (JP)

(72) Inventors: Shinichiro Fujimori, Kanagawa (JP); Takayuki Yamada, Kanagawa (JP); Taiyou Uehara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/228,089

(22) Filed: Aug. 4, 2016

(65) Prior Publication Data

US 2017/0212448 A1 Jul. 27, 2017

(30) Foreign Application Priority Data

Jan. 25, 2016 (JP) ..... 2016-011280

(51) Int. Cl.
*G03G 15/08* (2006.01)
*G03G 15/09* (2006.01)

(52) U.S. Cl.
CPC ..... *G03G 15/0896* (2013.01); *G03G 15/081* (2013.01); *G03G 15/0887* (2013.01); *G03G 15/09* (2013.01); *G03G 2215/0844* (2013.01)

(58) Field of Classification Search
CPC .. G03G 15/081; G03G 15/0887; G03G 15/09; G03G 21/206; G03G 2215/0844; G03G 15/0896
USPC ..... 399/92, 267, 272
See application file for complete search history.

(56) References Cited

U.S. PATENT DOCUMENTS 4,583,112 A * 4/1986 Morano ..... G03G 15/0898 399/103
5,995,780 A * 11/1999 Wayman ..... G03G 15/0898 399/93
6,067,428 A * 5/2000 Zirilli ..... G03G 15/0898 399/92

(Continued)

FOREIGN PATENT DOCUMENTS

JP 2008026487 A * 2/2008
JP 2014-134671 A 7/2014

(Continued)

*Primary Examiner* — Robert Beatty
(74) *Attorney, Agent, or Firm* — Sughrue Mion, PLLC

(57) ABSTRACT

A developing device includes a device housing, a developer holding member, and a supply member. The device housing contains developer. The developer holding member includes a magnetic field generating device and holds the developer. The supply member is rotated so as to lift the developer from below on a developer lifting side in a rotational direction thereof toward the developer holding member. The developing device has an exhaust passage that is provided along an outer circumference of the developer holding member and that allows air in the apparatus body to be exhausted therethrough. An opposite portion is defined on an opposite side to the developer lifting side in the rotational direction of the supply member. The developing device also includes a blocking member that intersects a tangent connecting the opposite portion to the inlet so as to block entrance of the developer into the exhaust passage.

3 Claims, 16 Drawing Sheets

(56) References Cited

U.S. PATENT DOCUMENTS

| | | | | |
|---|---|---|---|---|
| 6,606,468 | B2 * | 8/2003 | Yoshiki | G03G 15/0898 399/252 |
| 7,103,298 | B2 * | 9/2006 | Satoh | G03G 15/0942 399/267 |
| 7,991,318 | B2 * | 8/2011 | Tamura | G03G 15/0815 399/274 |
| 8,923,723 | B2 * | 12/2014 | Hirakawa | G03G 15/0898 399/279 |
| 9,195,168 | B2 * | 11/2015 | Ishii | G03G 15/0896 |
| 9,244,376 | B2 * | 1/2016 | Kuramoto | G03G 15/0806 |
| 2009/0232543 | A1 * | 9/2009 | Urasawa | G03G 15/0898 399/113 |
| 2016/0306291 | A1 * | 10/2016 | Kuroda | G03G 21/12 |

FOREIGN PATENT DOCUMENTS

| | | | | | |
|---|---|---|---|---|---|
| JP | 2014-178661 | A | | 9/2014 | |
| JP | 2015014760 | A | * | 1/2015 | G03G 15/0942 |
| JP | 2015072331 | A | * | 4/2015 | G03G 15/0806 |

* cited by examiner

DEVELOPING DEVICE INCLUDING EXHAUST PASSAGE AND BLOCKING MEMBER AND IMAGE FORMING APPARATUS

CROSS-REFERENCE TO RELATED APPLICATIONS

This application is based on and claims priority under 35 USC 119 from Japanese Patent Application No. 2016-011280 filed Jan. 25, 2016.

BACKGROUND (i) Technical Field

The present invention relates to a developing device and an image forming apparatus.

(ii) Related Art

Nowadays, due to an increase in the productivity of an image forming apparatus, the rotational speed of a developing roller tends to be increased in the developing device. Due to the increase in the rotational speed of the developing roller, the pressure in a device housing of the developing device is increased.

SUMMARY

According to an aspect of the present invention, a developing device includes a device housing, a developer holding member, and a supply member. The device housing contains developer. The developer holding member includes a magnetic field generating device therein and holds the developer. The supply member is rotated so as to lift the developer from below on a developer lifting side in a rotational direction thereof toward the developer holding member to supply the developer. The developing device has an exhaust passage that has an inlet, that is provided along an outer circumference of the developer holding member in the apparatus body, and that allows air in the apparatus body to be exhausted therethrough. An opposite portion is defined on an opposite side to the developer lifting side in the rotational direction of the supply member. The developing device also includes a blocking member that intersects a tangent connecting the opposite portion to the inlet of the exhaust passage so as to block entrance of the developer into the exhaust passage.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings.

Exemplary Embodiment

Figure 1:
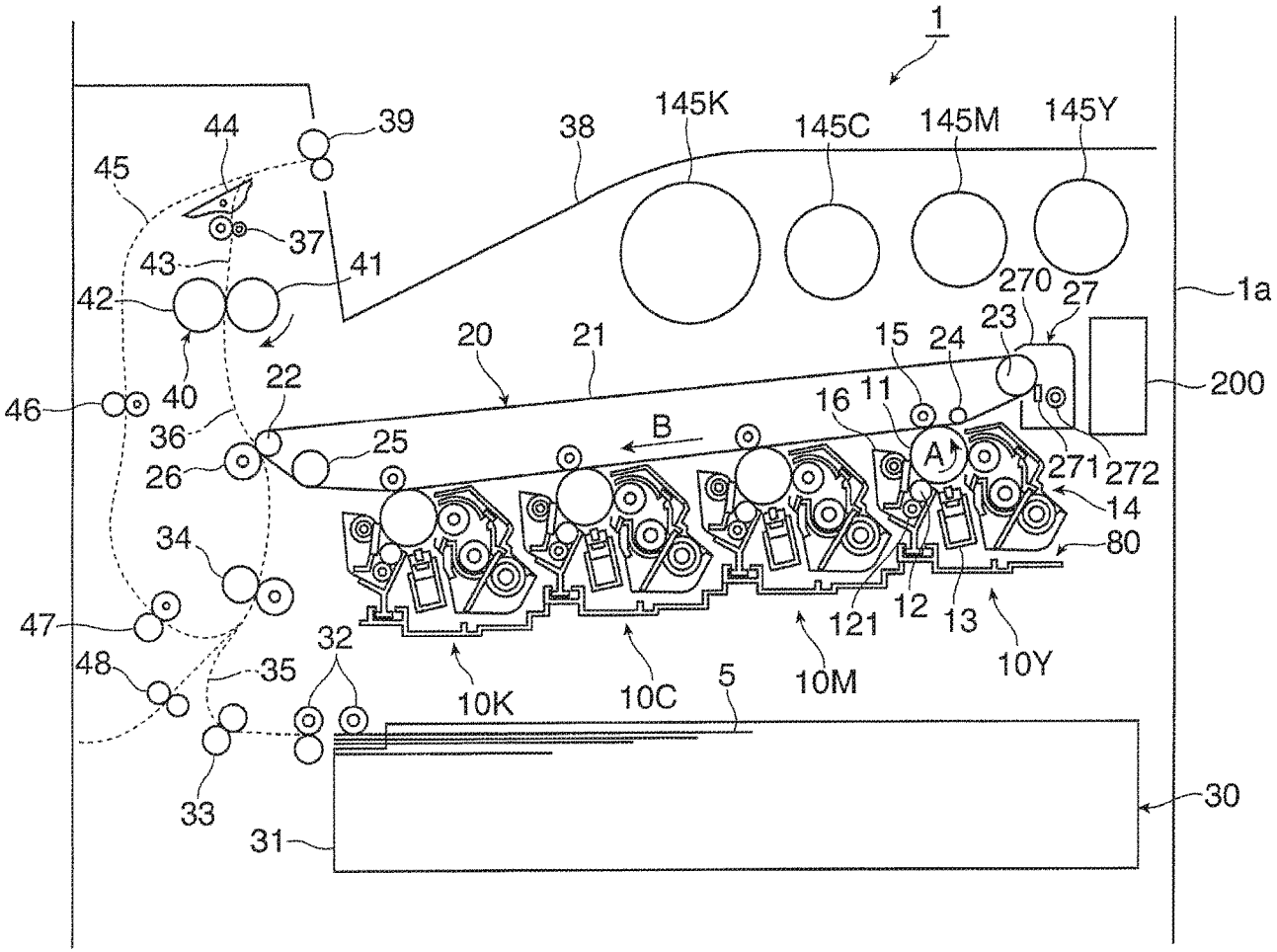
FIG. 1 is a schematic structural view of an image forming apparatus to which a developing device according to an exemplary embodiment of the present invention is applied.
Figure 2:
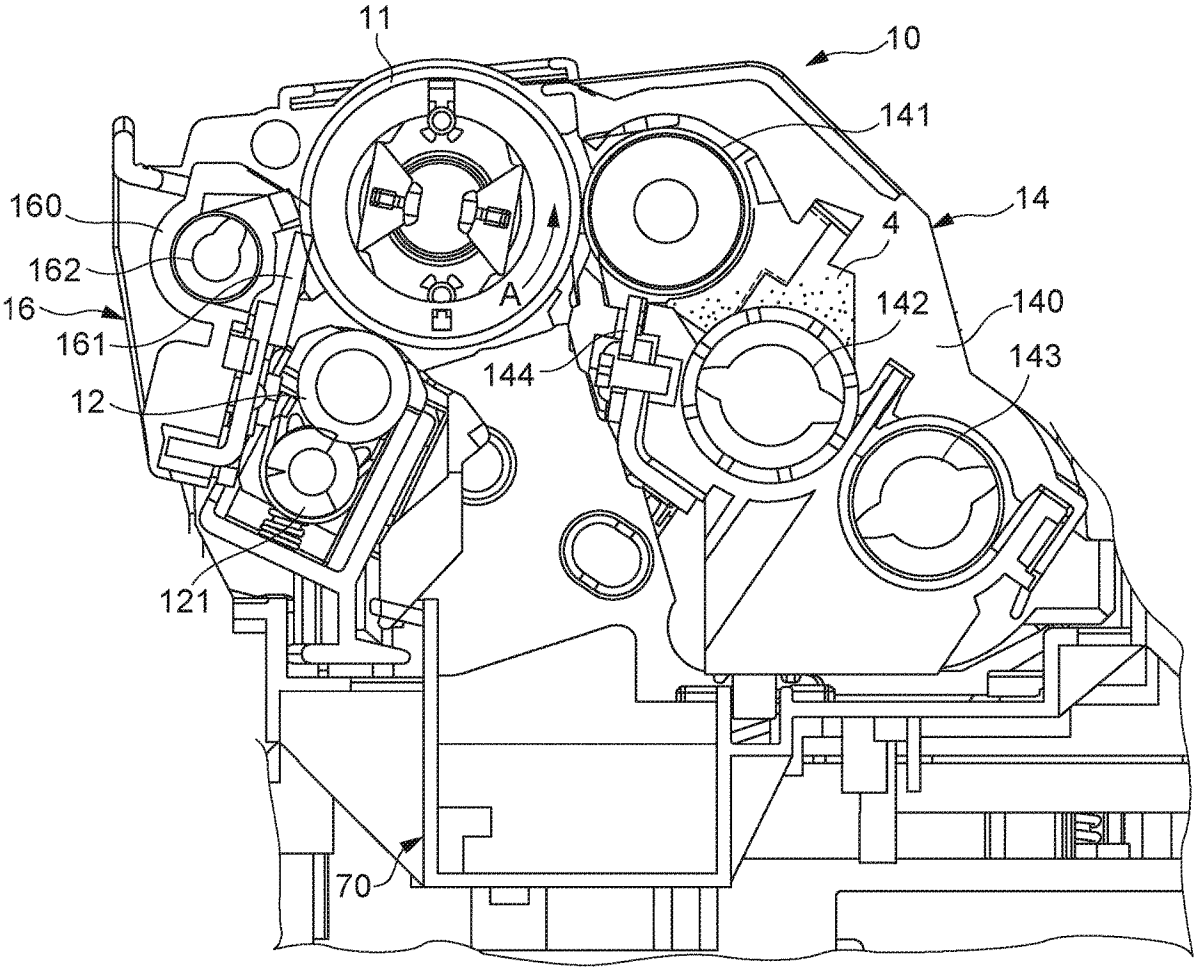
FIG. 2 is a structural view of an image forming section of the image forming apparatus according to the exemplary embodiment of the present invention.

FIGS. 1 and 2 illustrate an image forming apparatus to which a developing device according to an exemplary embodiment of the present invention is applied. FIG. 1 is a schematic overall view of the image forming apparatus, and FIG. 2 is an enlarged view of parts (such as an image forming device) of the image forming apparatus.

An Overall Structure of the Image Forming Apparatus

An image forming apparatus 1 according to the exemplary embodiment is structured as, for example, a color printer. The image forming apparatus 1 includes plural image forming devices 10, an intermediate transfer device 20, a sheet feed device 30, a fixing device 40, and so forth. The image forming devices 10 form toner images developed with toner included in developer 4. The intermediate transfer device 20 holds the toner images having been formed by the image forming devices 10 and transports the toner images to a second transfer position where the toner images are transferred through second transfer onto a recording sheet 5 at last. The recording sheet 5 serves as an example of a recording medium. The sheet feed device 30 contains and transports required recording sheets 5 to be supplied to the second transfer position of the intermediate transfer device 20. The fixing device 40 fixes the toner images having been transferred through the second transfer by the intermediate transfer device 20 onto the recording sheet 5. Reference numeral la of, for example, FIG. 1 denotes an apparatus body of the image forming apparatus 1. The apparatus body la includes a support structure member, an exterior covering, and so forth. Also in FIG. 1, broken lines indicate a transport path through which the recording sheet 5 is typically transported in the apparatus body la.

The image forming devices 10 include four image forming devices 10Y, 10M, 10C, and 10K that each dedicatedly form a toner image of a corresponding one of four colors, that is, yellow (Y), magenta (M), cyan (C), and black (K). Four image forming devices 10 (Y, M, C, and K) described above are arranged side by side in an inclined row in an inner space of the apparatus body 1*a*. Among four image forming devices 10 (Y, M, C, and K), the yellow (Y) image forming device 10Y is disposed at a relatively upper position and the black (K) image forming device 10K is disposed at a relatively lower position.

Four image forming devices 10 include the image forming devices 10 (Y, M, C, and K) for yellow (Y), magenta (M), cyan (C), and black (K). As illustrated in FIGS. 1 and 2, each of the image forming devices 10 (Y, M, C, and K) includes a corresponding one of rotating photosensitive drums 11. The photosensitive drums 11 each serve as an example of an image holding member. Devices included in a unit that serves as an example of a toner image forming section are typically disposed around each of the photosensitive drum 11 as follows. These devices include, for example, a charger 12, a light exposure device 13, a developing device 14 (Y, M, C, or K), a first transfer device 15 (Y, M, C, or K), and a drum cleaner 16 (Y, M, C, or K). The charger 12 charges to a required potential a circumferential surface (image holding surface) of the photosensitive drum 11 on which an image formation is possible. The light exposure device 13 serving as an example of a electrostatic latent image forming unit radiates light in accordance with information (signal) of an image to the charged circumferential surface of the photosensitive drum 11 so as to form an electrostatic latent image (for a corresponding one of the colors) having a potential difference. The developing device 14 serving as an example of a developing section develops the electrostatic latent image with the toner of the developer 4 of a corresponding one of the colors (Y, M, C, and K) so as to form a toner image. The first transfer device 15 serving as an example of a first transfer unit transfers the toner image onto the intermediate transfer device 20. The drum cleaner 16 cleans the photosensitive drum 11 by removing adhering matter such as toner remaining on and adhering to the image holding surface of the photosensitive drum 11 after the first transfer has been performed. Referring to FIG. 1, reference numerals such as 11 and 12 for the photosensitive drums 11 and the chargers 12 are indicated only for those components of the yellow (Y) image forming devices 10Y, and reference numerals for other image forming devices 10 (M, C, and K) are omitted from FIG. 1.

The photosensitive drum 11 includes a grounded cylindrical or columnar base member. The image holding surface having a photoconductive layer (photosensitive layer) made of a photosensitive material is formed on the circumferential surface of the base member. This photosensitive drum 11 is supported such that the photosensitive drum 11 is rotated in an arrow A direction by a motive force transmitted from a rotational drive device (not illustrated).

The charger 12 includes a contact-type charging roller disposed so as to be in contact with the photosensitive drum 11. The charger 12 also includes a cleaning roller 121 that cleans a surface of the charger 12. A charging voltage is supplied to the charger 12. In the case where the developing device 14 performs reversal development, a voltage or a current the polarity of which is the same as that of the toner supplied from this developing device 14 is supplied as the charging voltage. The charger 12 may be a contactless-type charging device such as a scorotron disposed on the surface of the photosensitive drum 11 in a state in which the charger 12 is not in contact with the photosensitive drum 11.

The light exposure device 13 includes a light-emitting-diode (LED) print head. The LED print head includes plural LEDs as light emitting elements arranged in the axial direction of the photosensitive drum 11 so as to radiate the light in accordance with the image information to the photosensitive drum 11, thereby forming the electrostatic latent image. Alternatively, the light exposure device 13 may use a laser light formed in accordance with the image information to perform deflection scanning in the axial direction of the photosensitive drum 11.

As illustrated in FIG. 2, each of the developing devices 14 (Y, M, C, and K) includes, for example, a developing roller 141, a supply and transport member 142, an agitating and transport member 143, and a layer-thickness regulating member 144. These components are disposed in a device housing 140 that has an opening and container chamber for the developer 4. The developing roller 141 serving as an example of a developer holding member holds the developer 4 and transports the developer 4 to a developing region facing the photosensitive drum 11. The supply and transport member 142 that includes a screw auger or the like supplies the developer 4 to the developing roller 141 while agitating the developer 4. The agitating and transport member 143 that includes a screw auger or the like transports the developer 4 while agitating the developer 4 between the supply and transport member 142 and the agitating and transport member 143. The layer-thickness regulating member 144 regulates the amount (layer thickness) of the developer 4 held by the developing roller 141. Two-component developer that includes non-magnetic toner and magnetic carrier is used as the developer 4 (Y, M, C, or K) of each of four colors. The details of the developing devices (Y, M, C, and K) will be described later.

Each of the first transfer devices 15 (Y, M, C, and K) is a contact-type transfer device that includes a first transfer roller. The first transfer roller is in contact with a circumference of the photosensitive drums 11 through an intermediate transfer belt 21 so as to be rotated. A first transfer voltage is supplied to the first transfer roller. As the first transfer voltage, a direct-current voltage the polarity of which is opposite to the polarity to which the toner is charged is supplied from a power unit (not illustrated).

As illustrated in FIG. 2, each of the drum cleaners 16 includes, for example, a body 160, a cleaning plate 161, and a feed member 162. The body 160 has a container shape and is partially opened. The cleaning plate 161 is disposed so as to be in contact at a required pressure with the circumferential surface of the photosensitive drum 11 having undergone the first transfer, thereby cleaning the circumferential surface of the photosensitive drum 11 by removing adhering matter such as residual toner. The feed member 162 that includes a screw auger or the like collects the adhering matter such as toner removed by the cleaning plate 161 and transports the adhering matter so as to feed the adhering matter to a collection system (not illustrated). A plate shaped member (for example, blade) formed of, for example, rubber is used as the cleaning plate 161.

As illustrated in FIG. 1, the intermediate transfer device 20 is disposed above the image forming devices 10 (Y, M, C, and K). The intermediate transfer device 20 includes, for example, the intermediate transfer belt 21, plural belt support rollers 22 to 25, a second transfer device 26, and a belt cleaner 27. The intermediate transfer belt 21 is rotated in an arrow B direction while passing through first transfer positions between the photosensitive drums 11 and the first transfer devices 15 (first transfer rollers). The intermediate transfer belt 21 is held in a desired state and rotatably supported from the inner circumferential side by the plural belt support rollers 22 to 25. The second transfer device 26 serving as an example of a second transfer unit is disposed on the outer circumferential surface (image holding surface) side of the intermediate transfer belt 21 at a position where the intermediate transfer belt 21 is supported by the belt support roller 22. The second transfer device 26 transfers through the second transfer the toner images on the intermediate transfer belt 21 onto the recording sheet 5. The belt cleaner 27 cleans the outer circumferential surface of the intermediate transfer belt 21 by removing adhering matter such as toner or paper dust remaining on and adhering to the outer circumferential surface of the intermediate transfer belt 21 after the intermediate transfer belt 21 has passed through the second transfer device 26. The intermediate transfer belt 21 of the intermediate transfer device 20 looped over the belt support roller 24 and the first transfer devices 15 is able to be moved to a retracted position separated from the photosensitive drums 11 (Y, M, C, and K) by operating an operating handle (not illustrated).

The intermediate transfer belt 21 is an endless belt formed of a material including, for example, synthetic resin such as polyimide resin or polyamide resin in which a resistance adjuster or the like such as carbon black is dispersed. The belt support roller 22 serves as a rear-surface support roller for the second transfer. The belt support roller 23 serves as a drive roller rotated by a drive device (not illustrated). The belt support roller 24 serves as a surface forming roller that forms an image forming surface of the intermediate transfer belt 21. The belt support roller 25 serves as a tension applying roller that applies tension to the intermediate transfer belt 21.

As illustrated in FIG. 1, the second transfer device 26 is a contact-type transfer device that includes a second transfer roller that is in contact with the circumferential surface of the intermediate transfer belt 21 so as to be rotated at the second transfer position which is part of the outer circumferential surface of the intermediate transfer belt 21 where the intermediate transfer belt 21 is supported by the belt support roller 22 of the intermediate transfer device 20. A second transfer voltage is supplied to the second transfer roller at the second transfer position. As the second transfer voltage, a direct-current voltage is supplied from a power unit (not illustrated) to the second transfer device 26 or the belt support roller 22 of the intermediate transfer device 20. The polarity of this direct-current voltage is opposite to or the same as the polarity to which the toner is charged.

As illustrated in FIG. 1, the belt cleaner 27 includes, for example, a body 270, a cleaning plate 271, and a feed member 272. The body 270 has a container shape and is partially opened. The cleaning plate 271 is disposed so as to be in contact at a required pressure with the circumferential surface of the intermediate transfer belt 21 having undergone the second transfer so as to clean the circumferential surface of the intermediate transfer belt 21 by removing the adhering matter such as residual toner. The feed member 272 that includes a screw auger or the like collects the adhering matter such as toner removed by the cleaning plate 271 and transports the adhering matter so as to feed the adhering matter to a collection system (not illustrated). A plate shaped member (for example, blade) formed of, for example, rubber is used as the cleaning plate 271.

The fixing device 40 includes, for example, a heating rotating member 41 and a pressure rotating member 42 which are disposed in a housing (not illustrated) having an entrance and an exit for the recording sheet 5. The heating rotating member 41 is in the form of a roller or a belt, rotated in a direction indicated by an arrow, and heated by a heating unit so that the surface temperature of the heating rotating member 41 is maintained at a specified temperature. The pressure rotating member 42 is in the form of a roller or a belt and in contact with the heating rotating member 41 substantially in the axial direction of the heating rotating member 41 at a specified pressure, thereby the pressure rotating member 42 is rotated. This fixing device 40 has a contact portion where the heating rotating member 41 and the pressure rotating member 42 are in contact with each other. The contact portion serves as a fixing process portion that performs required fixing processes (heating and application of pressure).

The sheet feed device 30 is disposed below the image forming devices 10 (Y, M, C, and K). This sheet feed device 30 includes, for example, at least one sheet container 31 and a feed device 32. The sheet container 31 contains the stacked recording sheets 5 of a size, type, and so forth a user wishes to use. The feed device 32 feeds one sheet after another from the recording sheets 5 contained in the sheet container 31. The sheet container 31 is attached so as to, for example, allow the sheet container 31 to be drawn to the front side (side facing the user who operates the sheet container 31) of the apparatus body 1*a*.

Examples of the recording sheets 5 include, for example, plain paper used for electrophotographic copiers, printers, and so forth, thin paper such as tracing paper, and overhead projector (OHP) transparencies. In order to further improve smoothness of image surfaces after fixing, smoothness of the front side of the recording sheets 5 may be increased as much as possible. For example, coated paper made by coating the front side of plain paper by resin or the like, so-called cardboard such as art paper for printing having a comparative large basis weight, and the like may also be used.

A sheet feed transport path 35 is provided between the sheet feed device 30 and the second transfer device 26. The sheet feed transport path 35 is formed by one or more sheet transport roller pairs 33 and 34 and a transport guide (not illustrated). The sheet transport roller pair 33 or the sheet transport roller pairs 33 and 34 transport each of the recording sheets 5 fed from the sheet feed device 30 to the second transfer position. The sheet transport roller pair 34, which is disposed at a position immediately upstream of the second transfer position in a sheet transport direction in the sheet feed transport path 35, serves as, for example, rollers that adjust timing at which the recording sheet 5 is transported (registration rollers). Furthermore, a sheet transport path 36 formed by a transport guide (not illustrated) is provided between the second transfer device 26 and the fixing device 40. The recording sheet 5 having undergone the second transfer and fed from the second transfer device 26 is transported to the fixing device 40 through the sheet transport path 36. Furthermore, an output transport path 43 provided with a sheet output roller pair 39 is disposed near a sheet output opening formed in the image forming apparatus body 1*a*. The sheet output roller pair 39 is used for outputting the recording sheet 5 having undergone fixing and fed from the fixing device 40 by an exit roller 37 to a sheet output unit 38 provided in an upper portion of the image forming apparatus body 1*a*.

A switching gate 44 is provided between the fixing device 40 and the sheet output roller pair 39. The switching gate 44 switches the sheet transport path. The rotational direction of the sheet output roller pair 39 is switchable between a forward direction (output direction) and a reverse direction. In order to form images on both sides of the recording sheet 5, the rotational direction of the sheet output roller pair 39 is switched from the forward direction (output direction) to the reverse direction after a trailing end of the recording sheet 5 on one side of which an image had been formed has been passed through the switching gate 44. The transport path of the recording sheet 5 to be transported in the reverse direction by the sheet output roller pair 39 is switched by the switching gate 44, so that this recording sheet 5 is transported to a duplex transport path 45 extending in the substantially vertical direction along the side surface of the image forming apparatus body 1*a*. The duplex transport path 45 is provided with a sheet transport roller pairs 46 and 47, a transport guide (not illustrated), and so forth. The sheet transport roller pairs 46 and 47 transport the recording sheet 5 to the sheet transport roller pair 34 such that the sheet 5 is inverted when the sheet reaches the sheet transport roller pair 34. Reference numeral 48 denotes a sheet transport roller pair that transports the recording sheet 5 fed from a manual feed tray (not illustrated) to the sheet transport roller pair 34.

Referring to FIG. 1, reference numerals 145 (Y, M, C, and K) denote plural toner cartridges that are each disposed in a direction perpendicular to the page of FIG. 1 and each contain the developer 4 that includes at least the toner supplied to a corresponding one of the developing devices 14 (Y, M, C, and K). According to the present exemplary embodiment, the two-component developer that includes the toner and the carrier is contained in each of the toner cartridges 145 (Y, M, C, and K). It is noted that the concentration of the toner of the two-component developer contained in each of the toner cartridges 145 (Y, M, C, and K) is set to be higher than that of the two-component developer set to a corresponding one of the developing devices 14.

Furthermore, reference numeral 200 of FIG. 1 denotes a controller that entirely controls operation of the image forming apparatus 1. The controller 200 includes components and so forth (not illustrated) such as a central processing unit (CPU), a read only memory (ROM), a random access memory (RAM), buses through which these CPU, ROM, and so forth are connected, and a communication interface.

Furthermore, reference numeral 80 of FIG. 1 denotes an insertion guide member that guides process cartridges 100 of the yellow (Y), magenta (M), cyan (C), and black (K) image forming devices 10 (Y, M, C, and K) when the process cartridges 100 are attached to or detached from the image forming apparatus body la as will be described later.

Operation of the Image Forming Apparatus

Basic image forming operation performed by the image forming apparatus 1 are described below.

Here, an operation in a full-color mode is described. In the full-color mode, a full-color image is formed by combining the toner images of four colors (Y, M, C, and K) by using four image forming devices 10 (Y, M, C, and K).

Upon reception of instruction information requesting a full-color image forming operation (printing) from a user interface (not illustrated), a printer driver (not illustrated), or the like, the image forming apparatus 1 starts four image forming devices 10 (Y, M, C, and K), the intermediate transfer device 20, the second transfer device 26, the fixing device 40, and so forth.

Consequently, in the image forming devices 10 (Y, M, C, and K), as illustrated in FIGS. 1 and 2, first, the photosensitive drums 11 are rotated in the arrow A direction, and the chargers 12 charge the surfaces of the respective photosensitive drums 11 to the required polarity (negative polarity according to the exemplary embodiment) and the required potentials. Next, the light exposure devices 13 radiate the light emitted in accordance with image signals obtained by converting image information input to the image forming apparatus 1 into color components (Y, M, C, and K) to the surfaces of the charged photosensitive drums 11. Thus, the electrostatic latent images for the respective color components having the required potentials are formed on the surfaces of the photosensitive drums 11.

Next, the image forming devices 10 (Y, M, C, and K) each supply the toner of a corresponding one of the colors (Y, M, C, and K) charged to the required polarity (negative polarity) from the developing roller 141 to the electrostatic latent image for the corresponding one of the color components formed on the photosensitive drum 11. Thus, the electrostatic latent image is developed by causing the toner to electrostatically adhere to the photosensitive drum 11. Through this development, the electrostatic latent image for the corresponding one of the color components formed on the photosensitive drum 11 is developed with the toner of the corresponding one of four colors (Y, M, C, and K) and becomes a visual toner image of the color.

Next, when the toner images of the colors formed on the photosensitive drums 11 of the image forming devices 10 (Y, M, C, and K) are transported to the first transfer positions, the first transfer devices 15 (Y, M, C, and K) transfer the toner images of the colors through the first transfer onto the intermediate transfer belt 21 of the intermediate transfer device 20 rotated in the arrow B direction such that the toner images are sequentially superposed on one another.

The drum cleaners 16 clean the surfaces of the photosensitive drums 11 by removing the adhering matter such that the adhering matter is scraped off from the surfaces of the photosensitive drums 11 in the image forming devices 10 (Y, M, C, and K) where the first transfer has been performed. Thus, the image forming devices 10 (Y, M, C, and K) are ready to perform the next image forming operation.

Next, the toner images having been transferred onto the intermediate transfer belt 21 through the first transfer are held by the intermediate transfer belt 21 and transported to the second transfer position by rotating the intermediate transfer belt 21 in the intermediate transfer device 20. Meanwhile, the sheet feed device 30 feeds the required recording sheet 5 to the sheet feed transport path 35 in accordance with the image forming operation. The recording sheet 5 is fed and supplied to the second transfer position by the sheet transport roller pair 34 serving as the registration rollers at timing adjusted to timing of the transfer in the sheet feed transport path 35.

The second transfer device 26 collectively transfers the toner images on the intermediate transfer belt 21 onto the recording sheet 5 through the second transfer at the second transfer position. Furthermore, the belt cleaner 27 cleans the surface of the intermediate transfer belt 21 by removing the adhering matter such as toner remaining on the surface of the intermediate transfer belt 21 after the second transfer has been performed in the intermediate transfer device 20 having undergone the second transfer.

Next, the recording sheet 5 onto which the toner images have been transferred through the second transfer is removed from the intermediate transfer belt 21 and then transported to the fixing device 40 through the sheet transport path 36. The recording sheet 5 having undergone the second transfer is introduced into and passes through the contact portion between the heating rotating member 41 being rotated and the pressure rotating member 42 being rotated so as to be subjected to required fixing processes (heating and application of pressure) in the fixing device 40. Thus, the unfixed toner images are fixed onto the recording sheet 5. At last, in the case of the image forming operation where image formation is performed on only one of the sides of the recording sheet 5, the recording sheet 5 having undergone the fixing is output to, for example, the sheet output unit 38 provided in the upper portion of the apparatus body la by the sheet output roller pair 39.

Through the above-described operation, the recording sheet 5 is output on which the full-color image made by combining the toner images of four colors has been formed.

A Structure of the Process Cartridges

Figure 3:
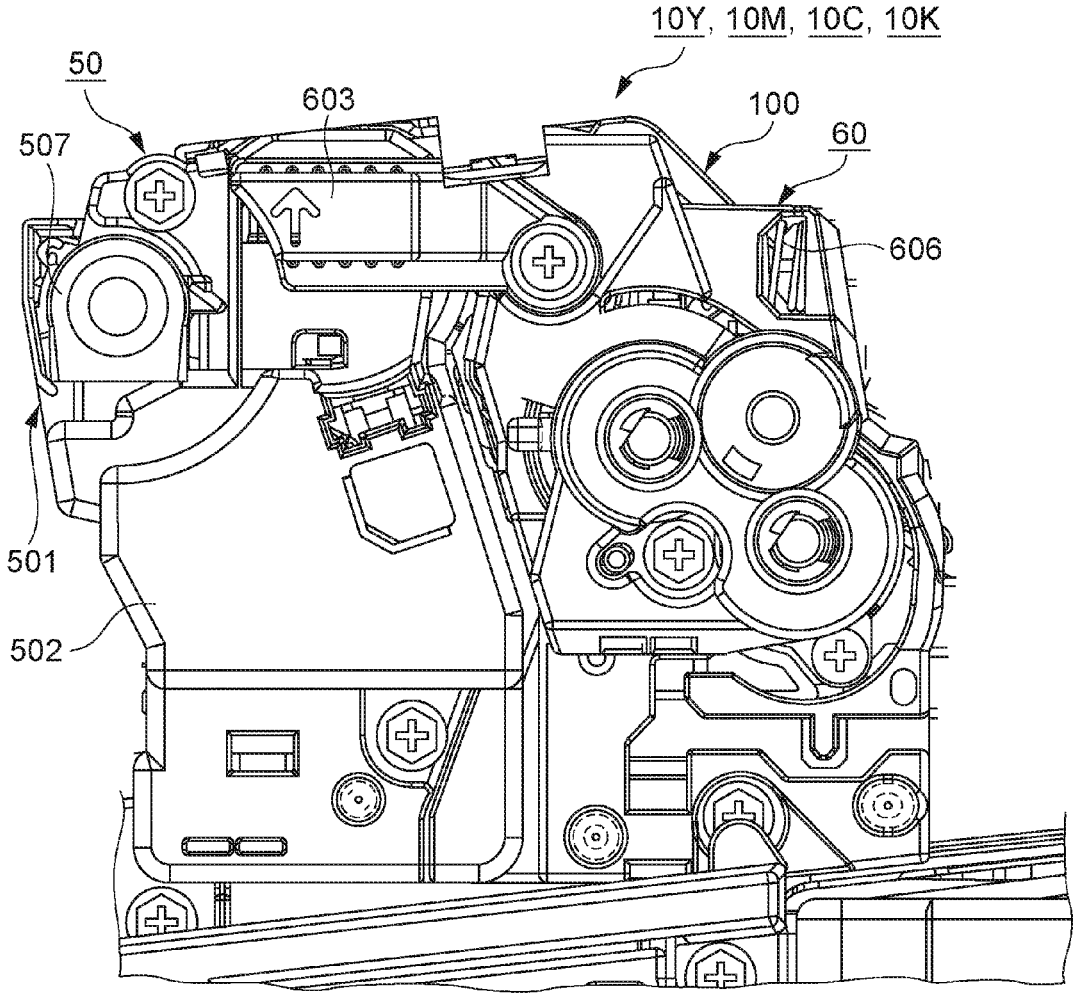
FIG. 3 is a structural view of a process cartridge of the image forming apparatus according to the exemplary embodiment of the present invention.

According to the present exemplary embodiment, as illustrated in FIG. 3, components included in the yellow (Y), magenta (M), cyan (C), and black (K) image forming devices 10 (Y, M, C, and K) are detachably attached to the image forming apparatus body la as the process cartridges 100. With consideration of, for example, the difference in time at which the components included in each of the image forming devices 10 are replaced, the process cartridge 100 includes a photosensitive unit 50, a developing unit 60, and a light exposure unit (not illustrated) as examples of plural detachable structures (image forming units). The photosensitive unit 50, the developing unit 60, and the light exposure unit are independently detachably attached to the image forming apparatus body 1*a*.

Figure 4:
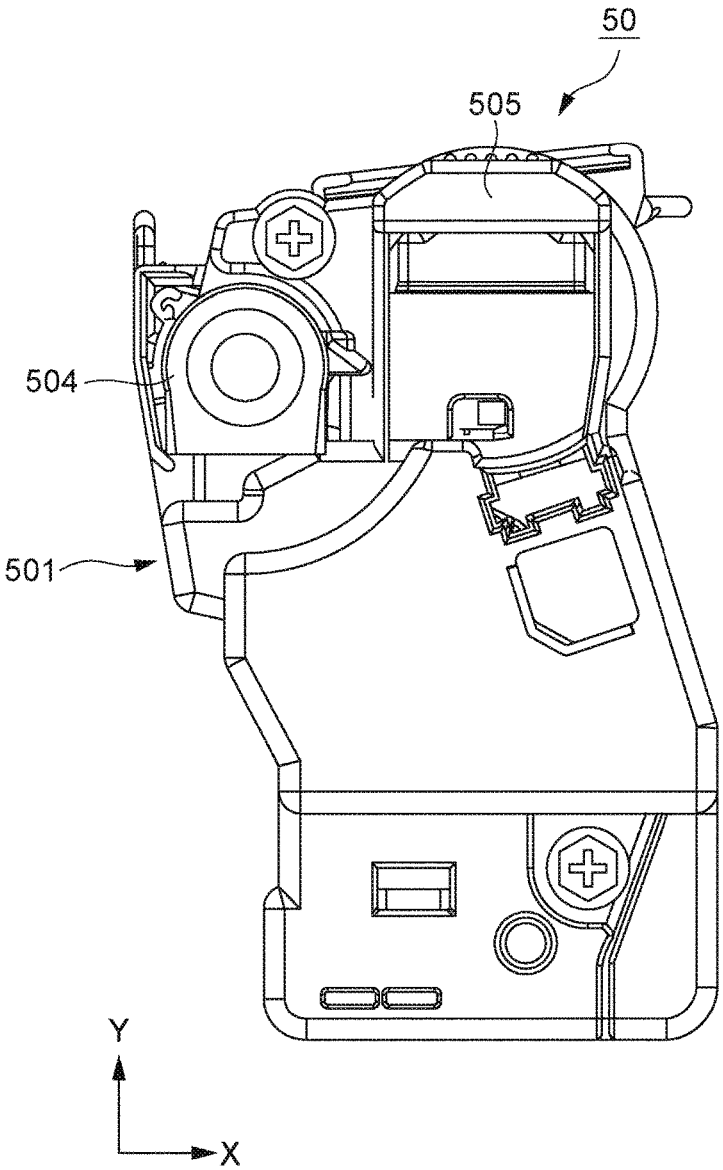
FIG. 4 is a structural front view of a photosensitive unit.
Figure 5:
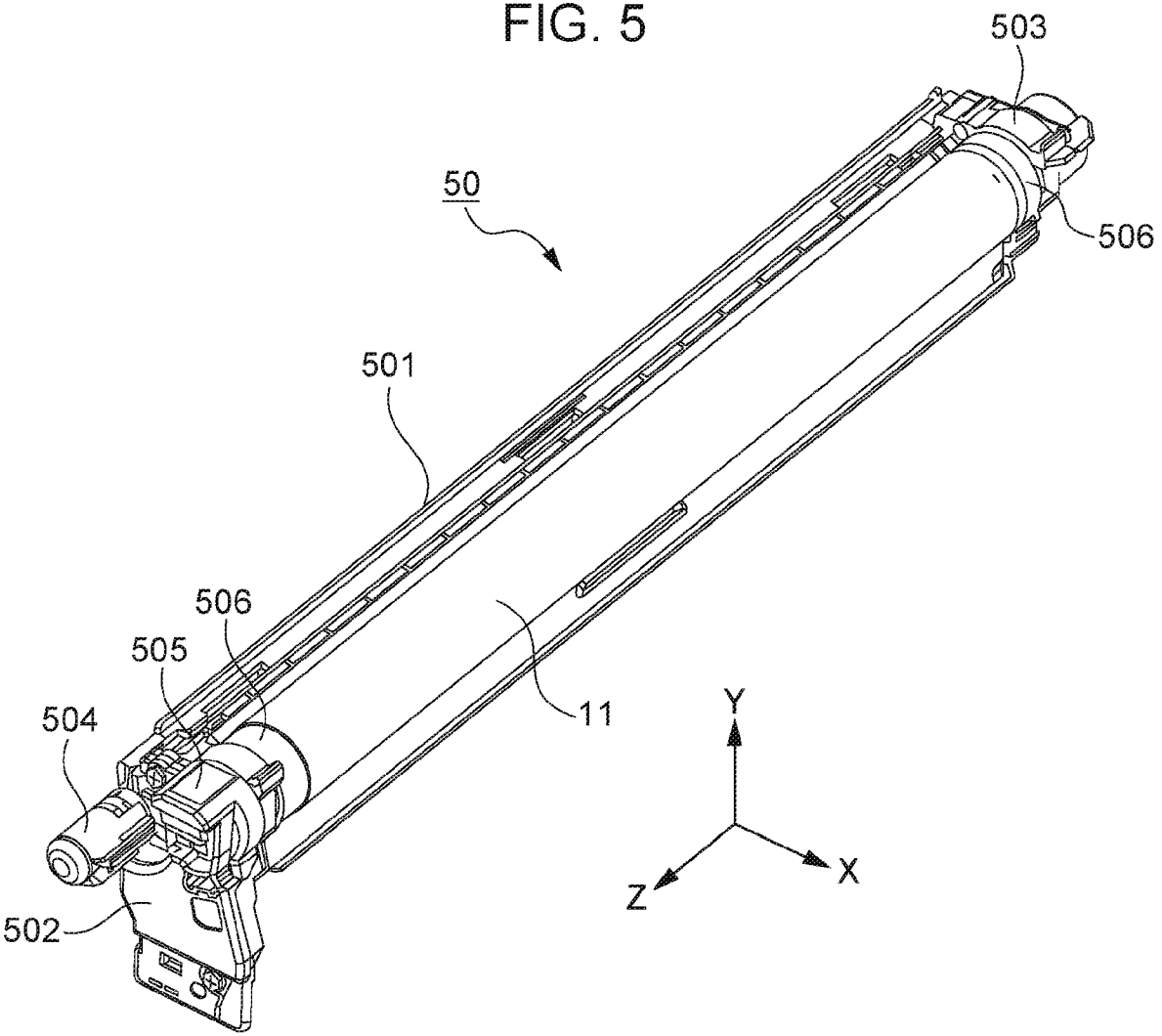
FIG. 5 is a structural perspective view of the photosensitive unit.

As illustrated in FIGS. 2, 4, and 5, the photosensitive unit 50 includes a photosensitive unit body 501. The photosensitive drum 11, the charger 12 disposed obliquely below the photosensitive drum 11, and the drum cleaner 16 disposed beside the photosensitive drum 11 are attached to the photosensitive unit body 501 so as to be integrated as a unit. The photosensitive drum 11 is rotatably supported by front and rear frames 502 and 503 disposed at front and rear end portions in an attachment direction of the photosensitive unit body 501.

A cylindrical discharge portion 504 is provided on the front frame 502 of the photosensitive unit 50 so as to project forward from the front frame 502. Recoverable matter having been collected by the drum cleaner 16 and fed by the feed member 162 is discharged through the discharge portion 504. The recoverable matter discharged through the discharge portion 504 of the front frame 502 is collected by a collection device 70 illustrated in FIG. 6 disposed on the front side of the image forming apparatus body 1*a*. Furthermore, as illustrated in FIGS. 4 and 5, a grip 505 is provided in an upper portion of the front frame 502. The grip 505 is held when the photosensitive unit 50 is detached from or attached to the image forming apparatus body 1*a*.

Figure 6:
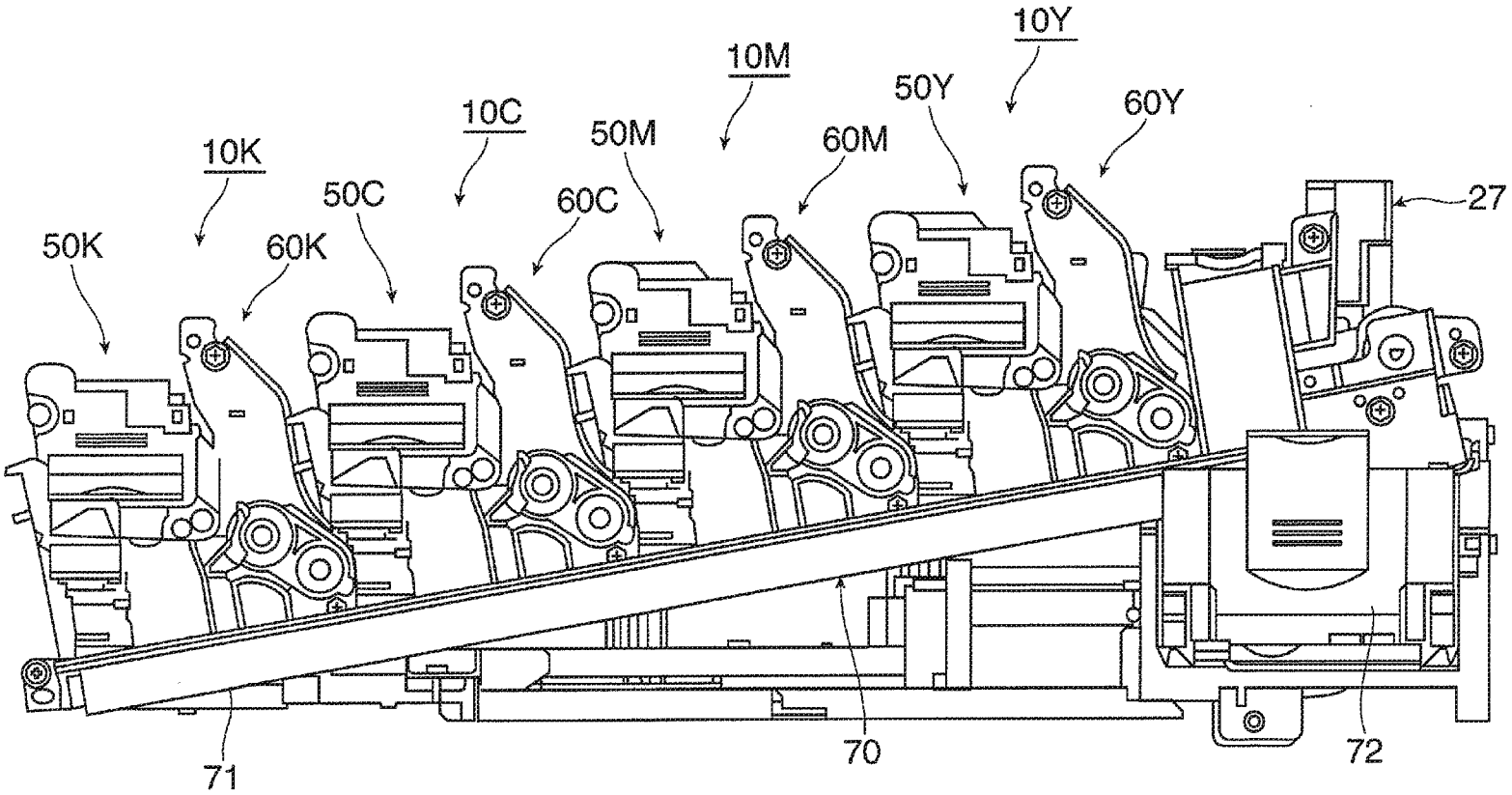
FIG. 6 is a structural view of a collection device.
Figure 7:
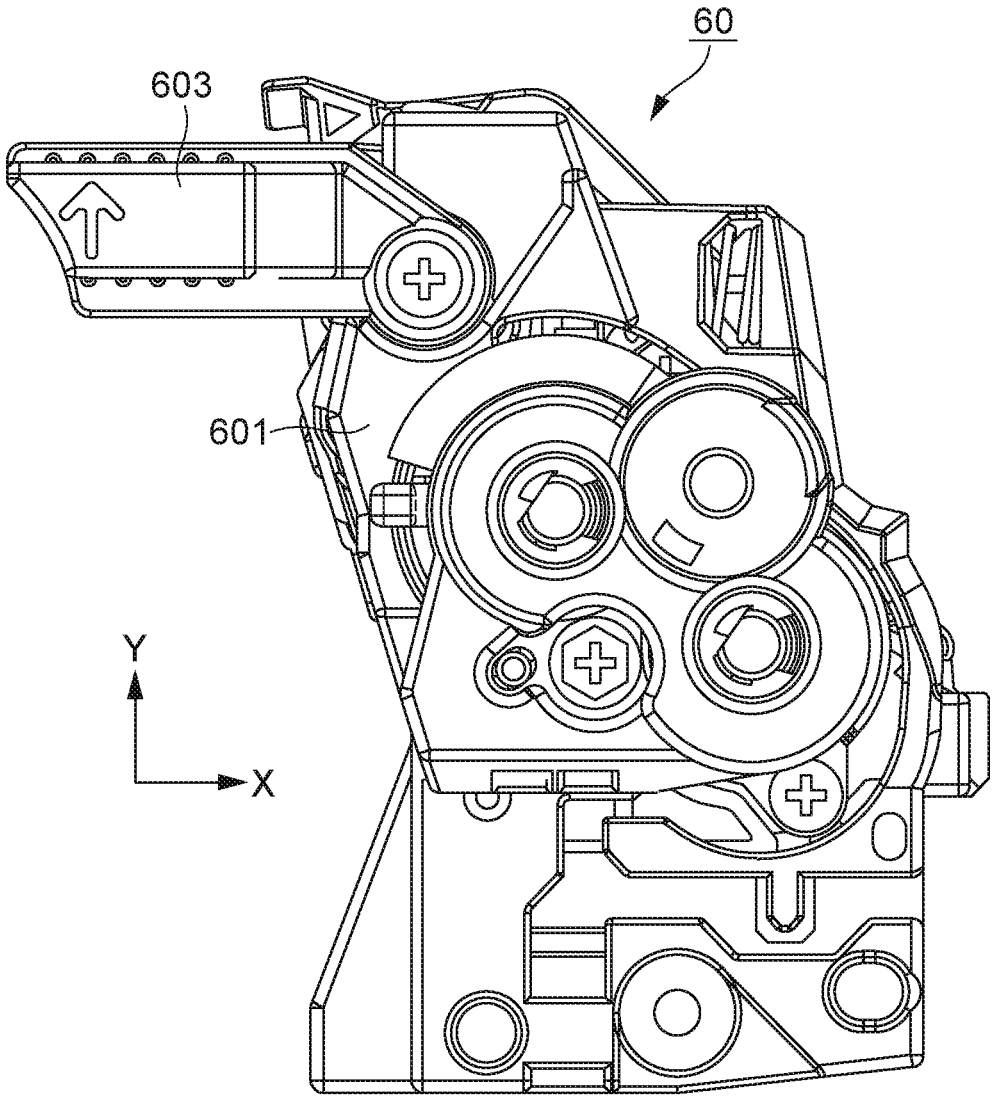
FIG. 7 is a structural front view of a developing unit.

As illustrated in FIG. 6, the collection device 70 includes a cylindrical transport device 71 and a collection container 72. The transport device 71 includes a transport member (not illustrated) that includes a screw auger or the like therein and transports the toner and wasted developer discharged from the photosensitive units 50 (Y, M, C, and K) and the developing units 60 (Y, M, C, and K) for yellow (Y), magenta (M), cyan (C), and black (K). The toner, the wasted developer, and the like transported by the transport device 71 are collected in the collection container 72. The toner and the like discharged from the belt cleaner 27 are directly collected in the collection container 72 because of dropping of the toner and the like due to the gravity.

As illustrated in FIG. 5, abutting members 506 that include bearings and the like are provided at both end portions of the photosensitive unit 50 in the axial direction of the photosensitive drum 11. As will be described later, the abutting members 506 are in contact with abutting members 152 on the developing unit 60 side so as to maintain a drum to roll space (DRS) between the photosensitive drum 11 and the developing roller 141 at a required value.

Meanwhile, the developing unit 60 includes the developing device 14 and a holder member 601. As illustrated in FIGS. 7 to 10, the holder member 601 is attached to a front end portion in the longitudinal direction (attaching direction) of the developing device 14. The developing device 14 is rotatably held by the holder member 601. The developing unit 60 has a positioning hole 146 (see FIG. 10) on the photosensitive unit 50 side at a lower end portion of a rear surface of the developing device housing 140. A positioning member (not illustrated) provided in the image forming apparatus body la is inserted into the positioning hole 146 for positioning. The holder member 601 includes a rotational shaft 602 (see FIG. 8) at the front end portion of the developing device housing 140 so as to correspond to the positioning hole 146. The developing device housing 140 is rotatably held by the rotational shaft 602.

Figure 9:
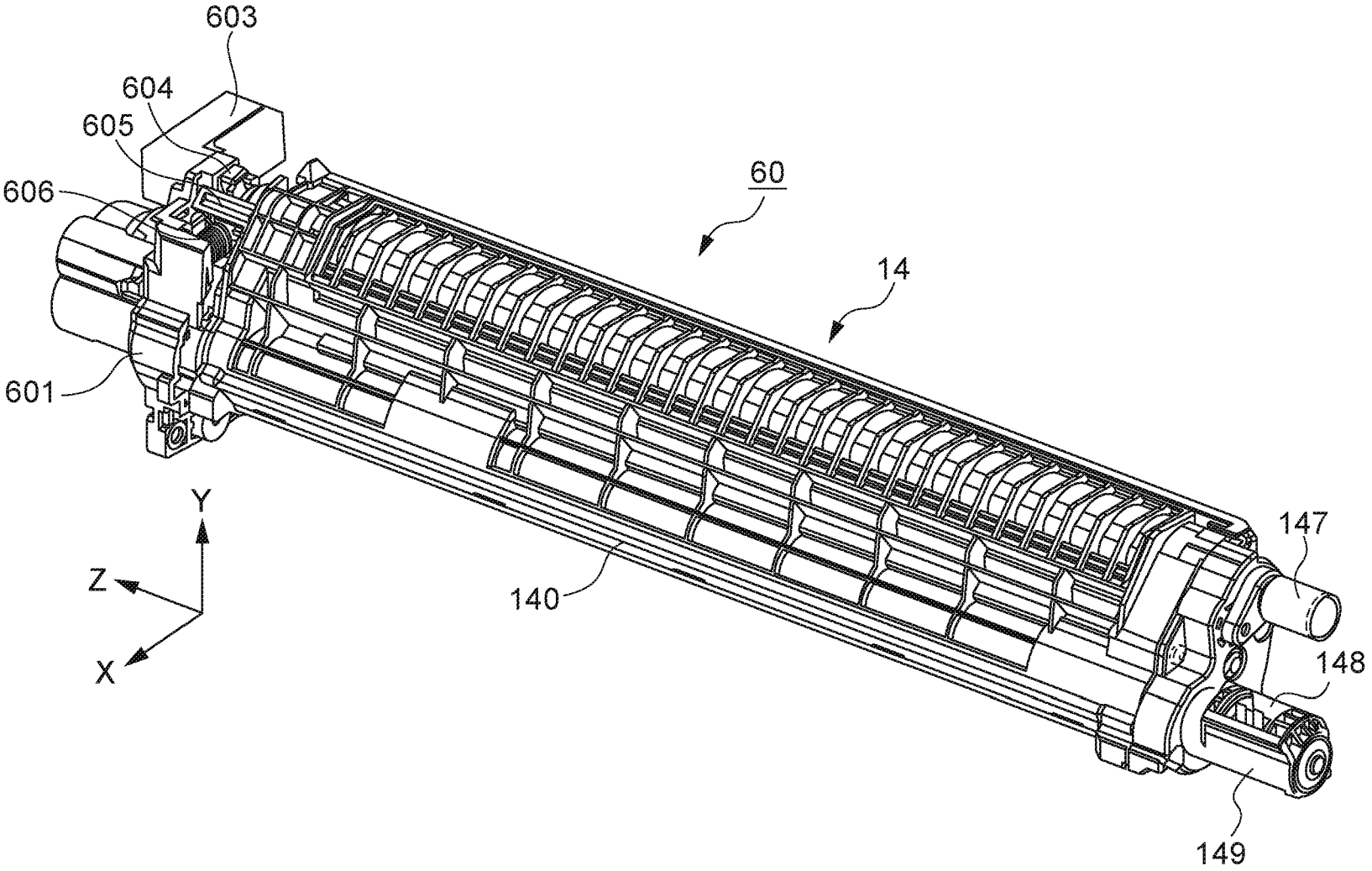
FIG. 9 is a structural perspective view of the developing unit.
Figure 10:
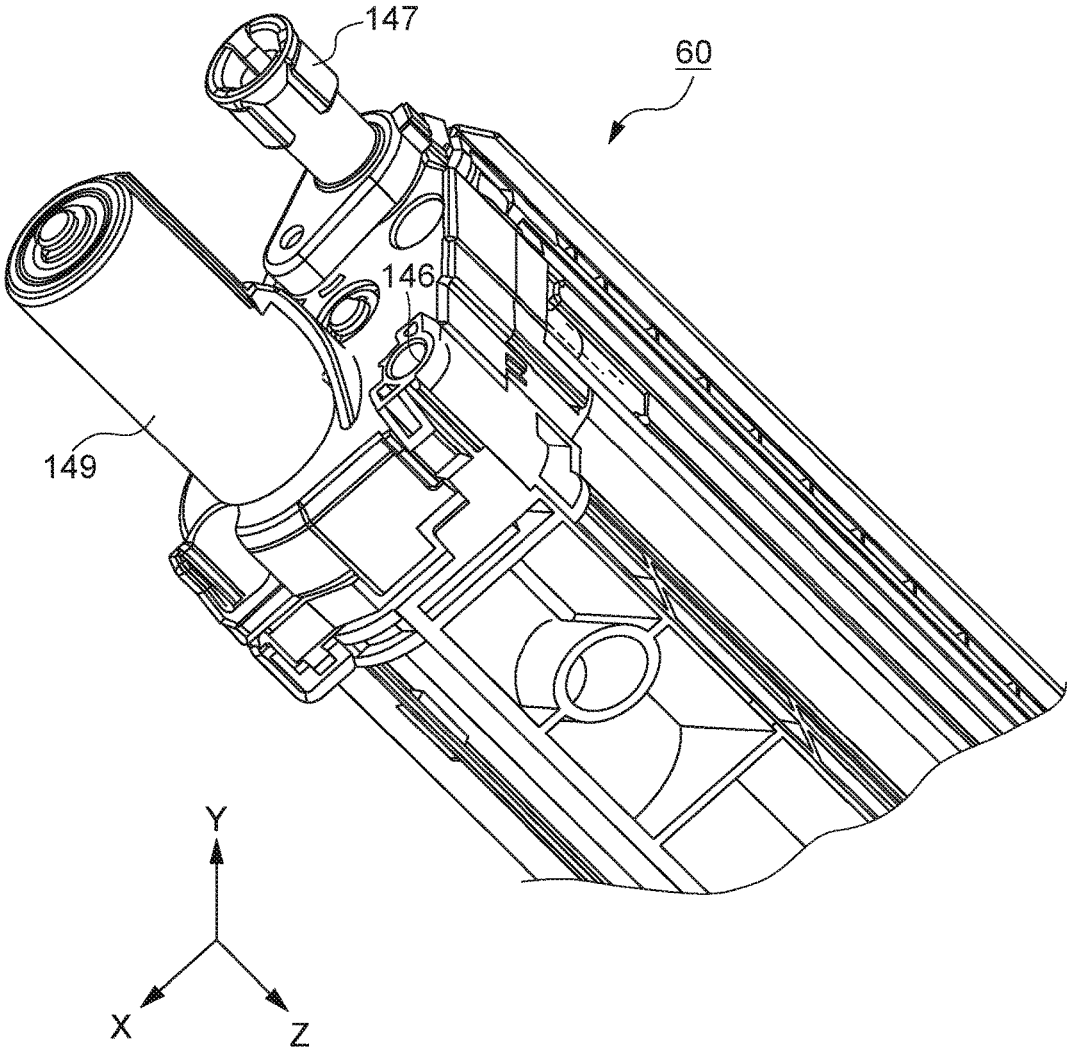
FIG. 10 is a structural perspective view of the developing unit.

A switching lever 603 is rotatably attached to the holder member 601. The switching lever 603 is used to switch the position of the developing device 14 between an operating position at which the developing device 14 is close to the photosensitive drum 11 and a retracted position at which the developing device 14 is separated from the photosensitive drum 11. As illustrated in FIG. 9, a cam member 604 that is rotated together with the switching lever 603 is provided on the inner surface of the holder member 601. Furthermore, an abutting portion 605 is provided at the front end portion in the longitudinal direction of the developing device 14. The abutting portion 605 is pressed by the cam member 604, thereby rotating the developing device 14 about the rotational shaft 602. Furthermore, a coil spring 606 is disposed on the inner surface of the holder member 601. The coil spring 606 serves as one of urging devices that push the abutting portion 605 from the rear side so as to urge the developing device 14 toward the operating position.

Also as illustrated in FIG. 9, a third drive-force transmission part 147 and a cylindrical supply part 149 are provided at a rear end portion in the longitudinal direction of the developing unit 60. The third drive-force transmission part 147 transmits a drive force to the developing roller 141. The supply part 149 has a supply port 148 through which the two-component developer 4 including the carrier is supplied from a corresponding one of the toner cartridges 145 to the developing device 14 by a toner supply device (not illustrated).

Figure 8:
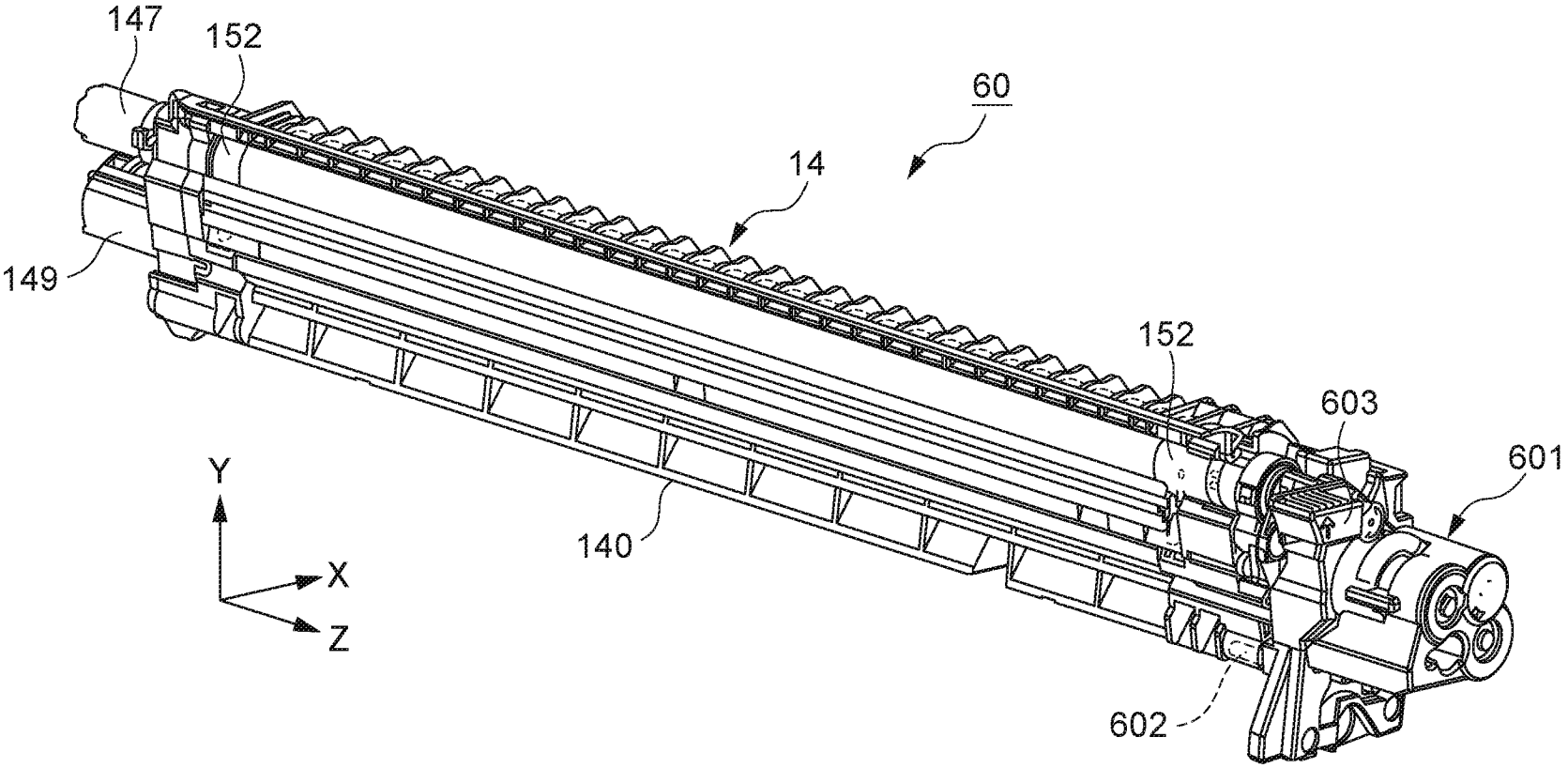
FIG. 8 is a structural perspective view of the developing unit.

Referring to FIG. 3, after the developing unit 60 has been attached to the image forming apparatus body 1*a*, the switching lever 603 is rotated counterclockwise in FIG. 3. This causes the front end portion of the developing device 14 in the longitudinal direction of the device housing 140 to be pushed by the coil spring 606 and a rear end portion of the developing device 14 in the longitudinal direction of the device housing 140 to be pushed by a coil spring (not illustrated). Thus, the front and rear end portions of the developing device 14 are rotated about the rotational shaft 602 and the positioning member, thereby the developing device 14 is positioned at the operating position. As illustrated in FIG. 8, the developing device 14 includes the abutting members 152, which include bearings and the like. The abutting members 152 are disposed at the respective end portions of the developing device 14 in the axial direction of the developing roller 141. The abutting members 152 of the developing device 14 abut the respective abutting members 506 (see FIG. 5), which includes the bearings and the like in the same way as or similarly to the abutting members 152, disposed at the respective end portions in the axial direction of the photosensitive drum 11, thereby the spaces (DRS) between the photosensitive drum 11 and the developing roller 141 are maintained at required values.

A Structure of the Developing Device

Figure 11:
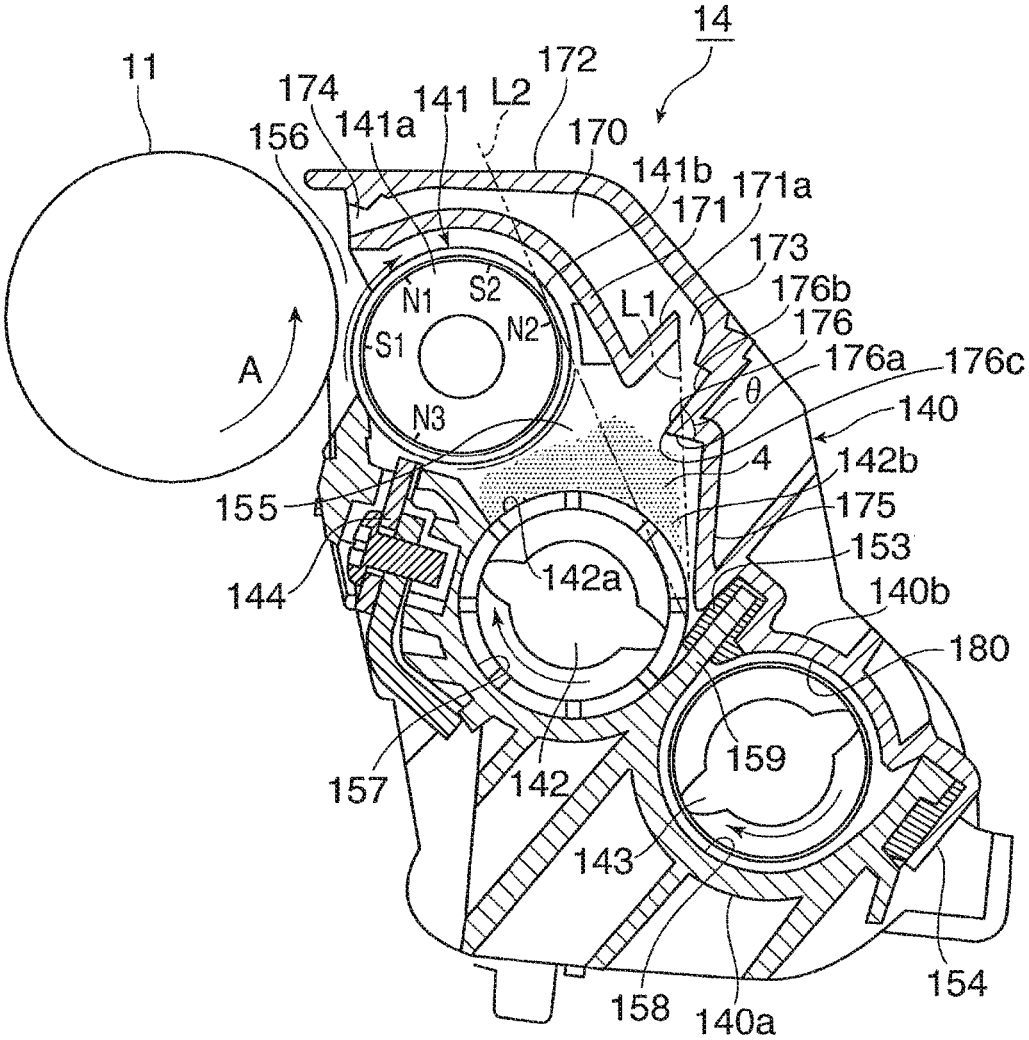
FIG. 11 is a structural sectional view of the developing device according to the exemplary embodiment of the present invention.

FIG. 11 is a structural sectional view of the developing device according to the exemplary embodiment of the present invention.

The developing device 14 includes the device housing 140 serving as an example of a device housing. Roughly divided, the device housing 140 has a lower housing 140*a* disposed in a lower portion of the developing device 14 and an upper housing 140*b* disposed in an upper portion of the developing device 14. The lower housing 140*a* and the upper housing 140*b* are airtightly connected to each other with spacer members 153 and 154 interposed therebetween. A developer container chamber 155 that contains the two-component developer 4 therein is formed in the device housing 140. An opening 156 is provided in a region of the device housing 140 facing the photosensitive drum 11. Furthermore, the developing roller 141 serving as an example of the developer holding member is disposed in the device housing 140 such that part of the developing roller 141 is exposed in the opening 156. The developing roller 141 is rotatable in an arrow direction. The developing roller 141 includes a magnetic roller 141*a* and a developing sleeve 141*b*. The magnetic roller 141*a* serving as an example of a magnetic field generating device is secured in the developing roller 141. Magnetic poles of required polarities are disposed at required positions of the magnetic roller 141*a*. The developing sleeve 141*b* is disposed at an outer circumference of the magnetic roller 141*a* such that the magnetic roller 141*a* is rotatable at a required rotational speed in an arrow direction. The developing sleeve 141*b* has a cylindrical shape formed of a non-magnetic material such as aluminum or non-magnetic stainless steel.

According to the present exemplary embodiment, the rotational direction of the developing sleeve 141*b* is set to be opposite to the rotational direction of the photosensitive drum 11. That is, as illustrated in FIG. 11, the rotational direction of the photosensitive drum 11 is set to be the counterclockwise direction and the rotational direction of the developing sleeve 141*b* is set to be the clockwise direction. As a result, in the developing region facing the photosensitive drum 11, an outer circumferential surface of the developing sleeve 141*b* is moved in the same direction as a movement direction of the surface of the photosensitive drum 11. The rotational direction of the developing sleeve 141*b* may be set to the same direction as the rotational direction of the photosensitive drum 11.

The rotational speed of the developing sleeve 141*b* is determined in accordance with productivity of the image forming apparatus 1, which is determined by the rotational speed of the photosensitive drums 11. As the number of A4 sized (long edge feed: LEF) recording sheets 5 printed per unit time as the productivity of the image forming apparatus 1 increases from 25 pages per minute (ppm), 55 ppm, 70 ppm, to 80 ppm, the rotational speed of the developing sleeve 141*b* increases.

The magnetic roller 141*a* includes the following poles: a developing pole S1 disposed at a position facing the photosensitive drum 11; a first transport pole N1 that is disposed downstream of the developing pole S1 in the rotational direction of the developing sleeve 141*b* and transports the developer 4 having been used for developing into the device housing 140; a second transport pole S2 that is disposed downstream of the first transport pole N1 in the rotational direction of the developing sleeve 141*b* and transports the developer 4 along the surface of the developing sleeve 141*b;* and a separation poles N2 and N3 that are disposed downstream of the second transport pole S2 in the rotational direction of the developing sleeve 141*b* and form a repulsive magnetic field so as to separate the developer 4 from the surface of the developing sleeve 141*b*. The separation pole N3 causes new developer 4 to be attracted from the inside of the developer container chamber 155 to the surface of the developing sleeve 141*b*, and the layer-thickness regulating member 144 disposed at a position facing the separation pole N3 regulates the amount (layer thickness) of the developer 4 held on the surface of the developing sleeve 141*b*. The developer 4 attracted by the separation pole N3 is transported to the developing pole S1.

The supply and transport member 142 that includes the screw auger (supply auger) or the like is disposed obliquely below the developing roller 141 in the device housing 140. The supply and transport member 142 lifts the developer 4 in the developer container chamber 155 so as to supply the developer 4 to the developing roller 141. The supply and transport member 142 is rotated clockwise by a drive device (not illustrated). Accordingly, a portion on a developer lifting side 142*a* of the supply and transport member 142 is a portion positioned on a photosensitive drum 11 side. Furthermore, the agitating and transport member 143 that includes the screw auger (admix auger) or the like is disposed obliquely below the supply and transport member 142 in the device housing 140. The agitating and transport member 143 transports the developer 4 supplied into the device housing 140 while agitating the developer 4. The agitating and transport member 143 is also rotated clockwise by a drive device (not illustrated).

The lower housing 140*a* has a first receiving portion 157 and a second receiving portion 158 having substantially semi-cylindrical shapes in sectional view so as to respectively receive the supply and transport member 142 and the agitating and transport member 143. The first receiving portion 157 and the second receiving portion 158 are partitioned by a partition 159 provided in the lower housing 140*a*. Furthermore, the upper housing 140*b* has a third receiving portion 180 having a substantially semi-cylindrical shape in sectional view. The third receiving portion 180 forms together with the second receiving portion 158 of the lower housing 140*a* a developer transport path.

Figure 12:
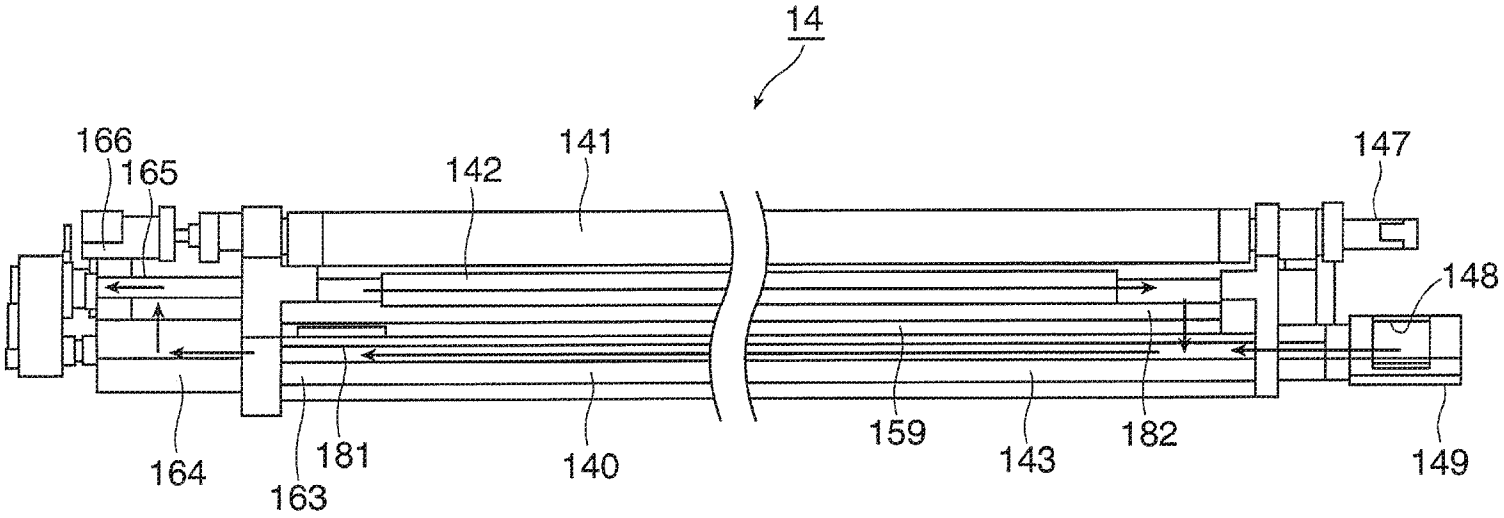
FIG. 12 is a structural sectional view of part of the image forming apparatus according to the exemplary embodiment of the present invention.

As illustrated in FIG. 12, a first passage 181 and a second passage 182 are provided at both end portions in the longitudinal direction of the partition 159. The developer 4 is delivered and received between the supply and transport member 142 and the agitating and transport member 143 through the first passage 181 and a second passage 182. Furthermore, a rear end portion of the agitating and transport member 143 in the axial direction of the agitating and transport member 143 extends so as to project to the rear side of the device housing 140. As illustrated in FIG. 9, the cylindrical supply part 149 is provided in the extending portion of the agitating and transport member 143. Furthermore, the supply port 148 is open in the cylindrical supply part 149. The developer 4 of a corresponding one of the colors is supplied from the toner cartridge 145 (Y, M, C, or K) through the supply port 148.

When the developing device 14 is used over time, in the developing device 14, the toner, an external additive to the toner, and the like adhere to the carrier of the two-component developer 4, and accordingly, the developer 4 is degraded. Thus, the charging performance of the toner is degraded when the toner and the carrier are transported while being agitated. It is known that, when the charging performance of the toner is degraded, image degradation such as density reduction and fogging occur due to charge deficiencies of the toner.

Accordingly, in order to suppress the occurrences of the image degradation caused by the charge deficiencies of the toner, a so-called trickle developing method is adopted for the developing device 14 according to the present exemplary embodiment. With the trickle developing method, excess developer that is part of the developer 4 contained in the device housing 140 is discharged to the outside while the developer 4 including the carrier is supplied into the device housing 140 of the developing device 14.

As illustrated in FIG. 12, a discharge transport blade 163 used to partially discharge the developer 4 is provided at a downstream end in the transport direction of the agitating and transport member 143 in the device housing 140 of the developing device 14. The transport direction in which the developer 4 is transported by the discharge transport blade 163 is set to be opposite to the transport direction in which the developer 4 is transported by a transport blade of the agitating and transport member 143. In a normal state, this discharge transport blade 163 pushes back the developer 4 transported by the agitating and transport member 143 to the upstream side in the transport direction, thereby transporting the developer 4 to the supply and transport member 142 through the first passage 181.

In contrast, when the amount of the developer 4 contained in the device housing 140 of the developing device 14 exceeds a specified amount, the excess developer 4 is moved beyond the discharge transport blade 163 and transported to the downstream side in the transport direction of the agitating and transport member 143. The agitating and transport member 143 includes an auxiliary transport blade 164 disposed downstream of the discharge transport blade 163. The auxiliary transport blade 164 transports the developer 4 to the downstream side in the transport direction of the agitating and transport member 143. The developer 4 transported by the auxiliary transport blade 164 is delivered to the supply and transport member 142 side. The supply and transport member 142 includes a second discharge transport blade 165 at an upstream end in an opposite direction to the transport direction of the supply and transport member 142. The second discharge transport blade 165 discharges the excess developer 4. A trickle outlet 166 is open downward at the end portion in the opposite direction to the transport direction of the supply and transport member 142. The excess developer 4 transported by the second discharge transport blade 165 is discharged through the trickle outlet 166.

Nowadays, in order to correspond to improvement of the productivity demanded for the image forming apparatus 1, rotational speeds of the developing roller 141 and the like of the developing device 14 structured as above tend to be increased. When the rotational speeds of the developing roller 141 and the like of the developing device 14 are increased, the amount of air introduced into the device housing 140 through the opening 156 due to the rotation of the developing roller 141 is increased. This tends to increase an internal pressure of the device housing 140.

Figure 13:
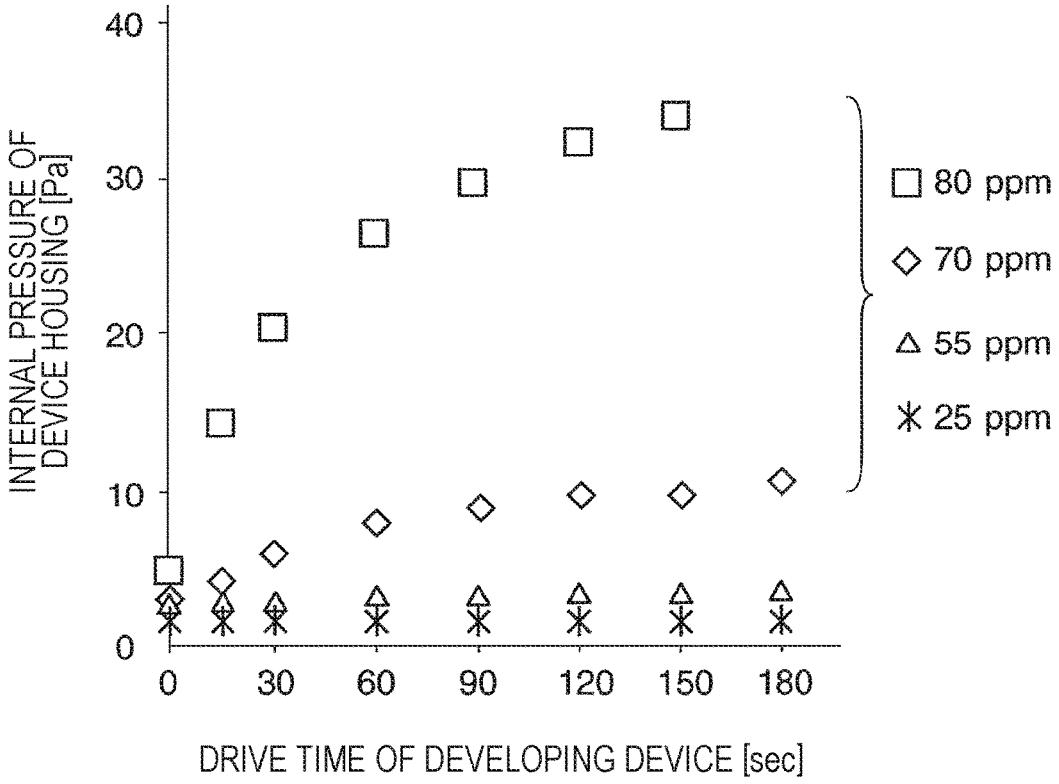
FIG. 13 is a graph illustrating the characteristics of a related-art developing device.

FIG. 13 is a graph illustrating results of measurement of the increase in the internal pressure of the device housing 140 with the developing device 14 continuously driven when the rotational speed of the developing roller 141 is increased in accordance with the improvement of the productivity of the image forming apparatus 1. The internal pressure of the device housing 140 is measured at a central portion in the axial direction on the supply and transport member 142 side.

As obvious in FIG. 13, in the case where the productivity of the image forming apparatus 1 is 25 ppm and 55 ppm, the increase in the internal pressure of the device housing 140 is not observed even when the developing device 14 is continuously driven.

In contrast, in the case where the productivity of the image forming apparatus 1 is improved to 70 ppm and 80 ppm, the internal pressure of the device housing 140 tends to increase due to the increase of the rotational speed of the developing roller 141. In particular, in the case where the productivity of the image forming apparatus 1 is 80 ppm, it is found that the internal pressure of the device housing 140 is suddenly increased to about 35 Pa due to the increase in the rotational speed of the developing roller 141 in a continuous drive for 180 sec.

When the internal pressure of the device housing 140 is increased, the toner and the developer 4 may flow out through both the end portions in the axial direction of the developing roller 141 and the trickle outlet 166.

Figure 14:
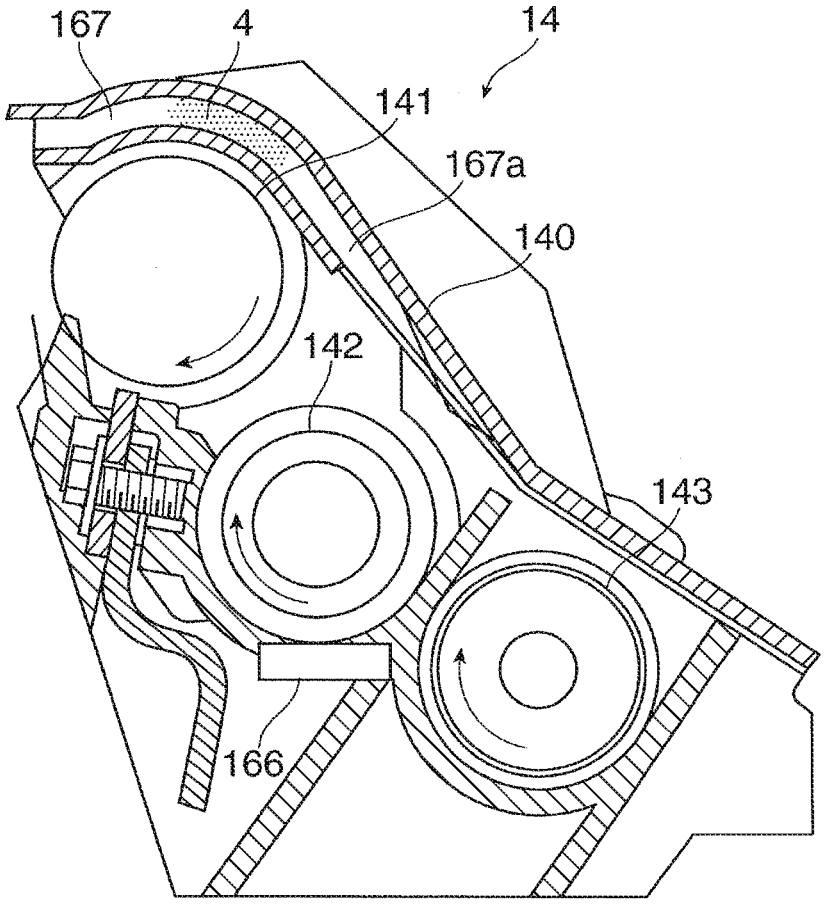
FIG. 14 is a structural view of the related-art developing device.

In order to suppress the flowing out of the toner and the developer 4 due to the increase in the rotational speeds of the developing roller 141 and the like, it is thought that an exhaust passage 167 is provided in the device housing 140 as illustrated in FIG. 14 so as to exhaust the air inside the device housing 140 through the exhaust passage 167, thereby to suppress the increase in the internal pressure of the device housing 140.

However, when the exhaust passage 167 is provided in the device housing 140 of the developing device 14, the developer 4 separated from the developing roller 141 is transported by the centrifugal force in a tangential direction of the developing roller 141 due to the increase in the rotational speeds of the developing roller 141 and the like. This developer 4 collides with an interface region between the downstream side in the rotational direction of the supply and transport member 142 and the partition, and consequently flies up and reaches an inlet 167*a* of the exhaust passage 167. Then, the developer 4 flying up in the device housing 140 enters the exhaust passage 167 through the inlet 167*a* and is caught by the magnetic force of the magnetic roller 141*a* while passing through the inside of the exhaust passage 167. This causes the exhaust passage 167 to be closed by the developer 4 over time. Accordingly, the suppressing of the increase in the internal pressure of the device housing 140 may be difficult.

Thus, according to the present exemplary embodiment, a blocking member is provided. The blocking member is disposed so as to intersect a tangent connecting the inlet of the exhaust passage to an opposite portion positioned on the opposite side to the developer lifting side in the rotational direction of the supply and transport member, thereby blocking entrance of the developer into the exhaust passage.

As illustrated in FIG. 11, the device housing 140 of the developing device 14 has an exhaust passage 170 at a position corresponding to an upper portion of the developing roller 141 (ceiling). The air inside the device housing 140 is exhausted to the outside through the exhaust passage 170. The exhaust passage 170 is formed by a substantially cylindrical inner circumferential wall 171 and an outer circumferential wall 172. The inner circumferential wall 171 is disposed on the outer circumferential side of the developing roller 141 with a required gap therebetween. The outer circumferential wall 172 is disposed on the outer circumferential side of the inner circumferential wall 171 with a required gap therebetween. The outer circumferential wall 172 may be formed separately from the upper housing 140*b* or integrally formed with the upper housing 140*b*. The exhaust passage 170 has an inlet 173. At the inlet 173, an end portion 171*a* is formed by bending the inner circumferential wall 171 to the outer circumferential wall 172 side. Thus, the inlet 173 is narrower than the gap of the exhaust passage 170. Furthermore, the exhaust passage 170 has an outlet 174 that is open to the photosensitive drum 11 side.

The device housing 140 of the developing device 14 includes an erect wall 175 that has a plate shape, that substantially vertically extends upward, and that is formed by part of the upper housing 140*b* at an opposite portion positioned on an opposite side 142*b* to the developer lifting side 142*a* in the rotational direction of the supply and transport member 142. A blocking member 176 having a substantially triangular shape in sectional view is integrally formed with the erect wall 175 at an upper end portion of the erect wall 175. The blocking member 176 projects to the developing roller 141 side and disposed so as to intersect a tangent L1 connecting the inlet 173 of the exhaust passage 170 to the opposite portion positioned on the opposite side 142*b* to the developer lifting side 142*a* in the rotational direction of the supply and transport member 142.

A lower end surface 176*a* of the blocking member 176 is substantially perpendicular to the erect wall 175 of the upper housing 140*b*. An upper end surface 176*b* of the blocking member 176 is disposed at an acute angle θ relative to the lower end surface 176*a* and substantially parallel to the end portion 171*a* of the inner circumferential wall 171. A distal end 176*c* of the blocking member 176 is disposed at a position separated further from the magnetic roller 141*a* than a tangent L2 connecting the developing roller 141 to the supply and transport member 142. Operation of a Characteristic Part of the Developing Device Referring to FIG. 2, in the developing device 14 according to the exemplary embodiment, in order to develop the electrostatic latent image formed on the surface of the photosensitive drum 11, the developing roller 141 is rotated clockwise by a drive device (not illustrated) at a speed corresponding to a process speed, which is a rotational speed (circumferential speed) of the photosensitive drum 11. Also in the developing device 14, the supply and transport member 142 and the agitating and transport member 143 are rotated by the drive devices (not illustrated) at speeds corresponding to the rotational speed of the developing roller 141.

Figure 15:
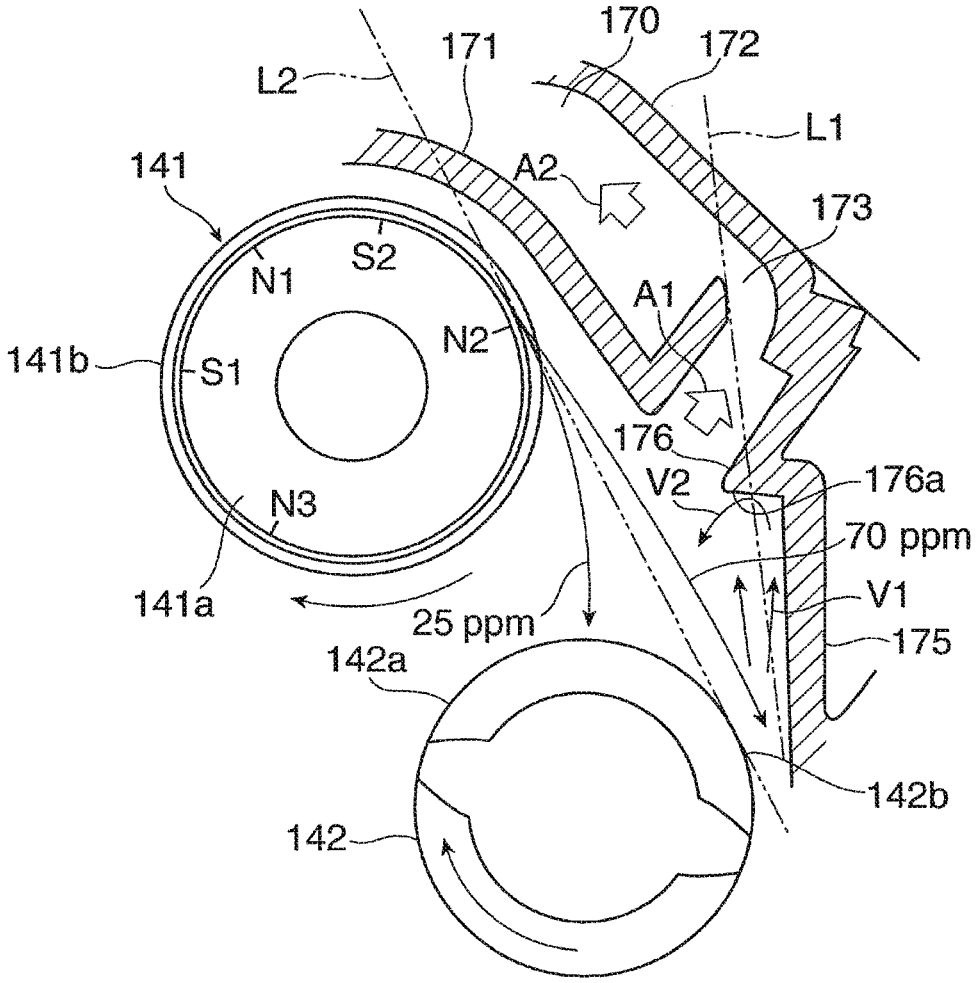
FIG. 15 illustrates operation of the developing device according to the exemplary embodiment of the present invention.

As illustrated in FIG. 15, in the developing device 14, as the rotational speed of the developing roller 141 is increased, the developer 4 separated from the surface of the developing sleeve 141*b* due to the repulsive magnetic field formed by the separation pole N2 of the magnetic roller 141*a* is caused to fly to a far region by the centrifugal force produced due to the rotation of the developing sleeve 141*b*. When the rotational speed of the developing sleeve 141*b* corresponds to the productivity of the image forming apparatus 1 of 25 ppm, the developer 4 separated from the developing sleeve 141*b* drops on an upper portion of the supply and transport member 142 and is agitated and transported together with the developer 4 due to the rotation of the supply and transport member 142.

When the rotational speed of the developing sleeve 141*b* is increased to a speed corresponding to the productivity of the image forming apparatus 1 of 70 ppm, the developer 4 separated from the developing sleeve 141*b* is caused to fly to an opposite region on the opposite side 142*b* to the developer lifting side 142*a* of the supply and transport member 142 by the centrifugal force produced due to the rotation of the developing sleeve 141*b*. Accordingly, the developer 4 separated from the developing sleeve 141*b* collides with the erect wall 175 at the opposite region on the opposite side 142*b* to the developer lifting side 142*a* of the supply and transport member 142 and flies upward as indicated by arrow V1.

The blocking member 176 is disposed so as to intersect the tangent L1 connecting the inlet 173 of the exhaust passage 170 to the opposite portion positioned on the opposite side 142*b* to the developer lifting side 142*a* in the rotational direction of the supply and transport member 142. As a result, the developer 4 flying upward hits the lower end surface 176*a* of the blocking member 176 and drops downward as indicated by an arrow V2. Furthermore, the air in the device housing 140 is separated from the developer 4 having flown upward, moved toward the inlet 173 of the exhaust passage 170 as indicated by an arrow A1, passes through the exhaust passage 170 as indicated by an arrow A2, and is exhausted toward the photosensitive drum 11 side through the outlet 174 of the exhaust passage 170.

Thus, according to the present exemplary embodiment, even when the rotational speed of the developing sleeve 141*b* is increased to such a degree of speed that the developer 4 separated from the developing sleeve 141*b* reaches the opposite region on the opposite side 142*b* to the developer lifting side 142*a* of the supply and transport member 142 by the centrifugal force produced due to the rotation of the developing sleeve 141*b*, entrance of the developer 4 flying up on the opposite region on the opposite side 142*b* to the developer lifting side 142*a* of the supply and transport member 142 into the inlet 173 of the exhaust passage 170 may be suppressed. Accordingly, a situation in which the exhaust passage 170 is clogged with the developer 4 that enters the exhaust passage 170 and is caught by the magnetic force of the magnetic roller 141*a* may be avoided or suppressed.

An Example of an Experiment

Next, a prototype of the developing device 14 as illustrated in FIG. 11 is prepared and continuously driven. The degree of the increase in the internal pressure of the device housing 140 of the developing device 14 in the case of the continuous drive is checked in an experiment. The rotational speed of the developing sleeve 141*b* is set to a speed corresponding to the productivity of the image forming apparatus 1 of 80 ppm. Furthermore, as a comparative example, a prototype of the developing device 14 as illustrated in FIG. 14 is prepared and continuously driven. The degree of the increase in the internal pressure of the device housing 140 of the developing device 14 in the case of the continuous drive is also checked in the experiment.

Figure 16:
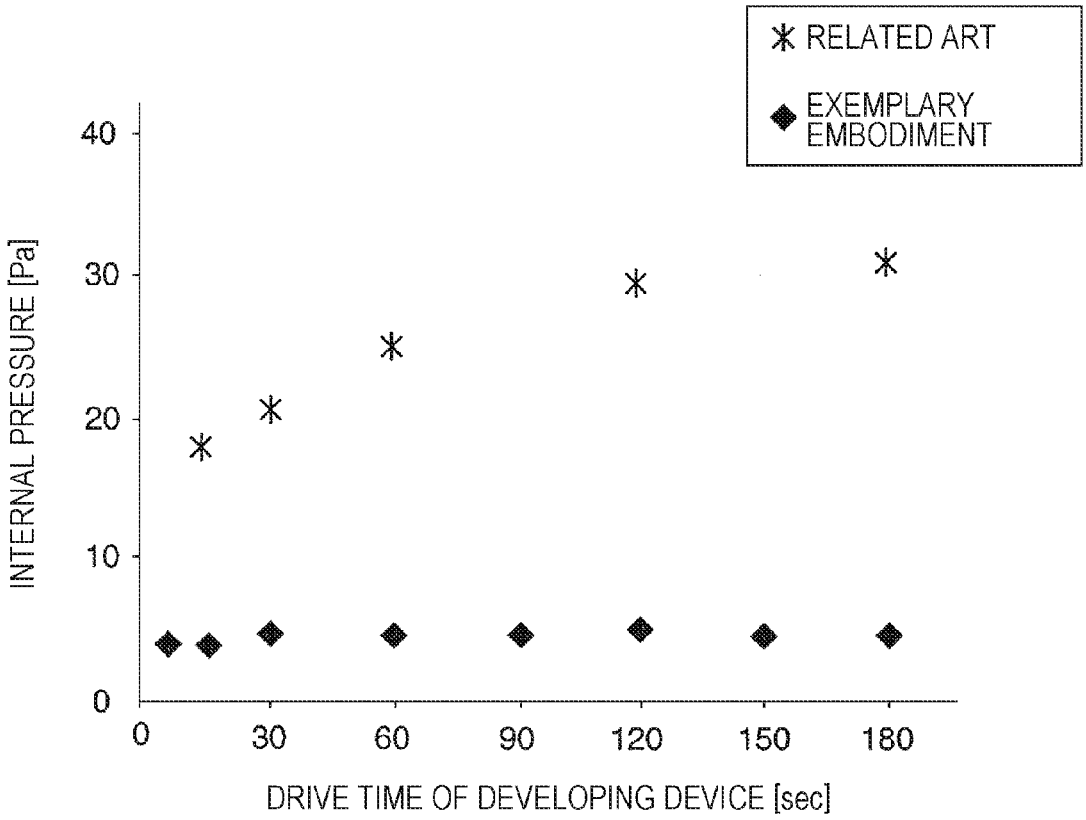
FIG. 16 is a graph illustrating results of an example of an experiment.

FIG. 16 is a graph illustrating results of the example of the experiment.

As obvious in the graph of FIG. 16, it is understood that, with the developing device 14 according to the present exemplary embodiment, even when the rotational speed of the developing sleeve 141*b* is increased to a speed correspond to the productivity of the image forming apparatus 1 of 80 ppm, the internal pressure of the device housing 140 is substantially fixed at about 5 Pa, and the increase in the internal pressure of the device housing 140 caused by clogging of the exhaust passage 170 with the developer 4 may be avoided.

In contrast, it is understood that, with the related-art developing device 14 of FIG. 14, when the rotational speed of the developing sleeve 141*b* is increased to a speed corresponding to the productivity of the image forming apparatus 1 of 80 ppm, the internal pressure of the device housing 140 is increased to about 30 Pa, and clogging of the exhaust passage 170 with the developer 4 may occur.

Although the developing device is included in the developing unit detachably attached to the image forming apparatus according to the above-described exemplary embodiment, the developing device may be secured to the image forming apparatus.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a device housing configured to contain developer;

a developer holding member configured to include a magnetic field generating device therein and to hold the developer; and a supply member configured to rotate so as to lift the developer from below on a developer lifting side in a rotational direction thereof toward the developer holding member to supply the developer, wherein the developing device comprises an exhaust passage that comprises an inlet, that is provided along an outer circumference of the developer holding member in the device housing, and that allows air in the device housing to be exhausted therethrough, wherein an opposite portion is defined on an opposite side to the developer lifting side in the rotational direction of the supply member, wherein the developing device comprises a blocking member that intersects a tangent connecting the opposite portion to the inlet of the exhaust passage so as to block entrance of the developer into the exhaust passage, wherein the blocking member comprises a distal end disposed at a position separated further from the magnetic field generating device than a tangent connecting the developer holding member to the supply member, wherein the device housing comprises an inner wall having an upper portion, and the inner wall is positioned on the opposite side to the developer lifting side in the rotational direction of the supply member, and wherein the blocking member is integrally formed with the inner wall in the upper portion of the inner wall.

2. The developing device according to claim 1, wherein the developer holding member is configured to rotate at a speed at which the developer separated from the developer holding member reaches the opposite portion positioned on the opposite side to the developer lifting side in the rotational direction of the supply member.

3. An image forming apparatus comprising:

an image holding member configured to hold an electrostatic latent image; and a developing section configured to develop the electrostatic latent image held by the image holding member, wherein the developing device according to claim 1 serves as the developing section.

* * * * *